US009715782B2

(12) United States Patent
Solaja

(10) Patent No.: US 9,715,782 B2
(45) Date of Patent: Jul. 25, 2017

(54) COMPUTERISED METHOD OF PRESENTING A GAME SELECTION SCREEN IN A MULTI GAME ENVIRONMENT

(71) Applicant: Atlas Gaming Technologies Pty Ltd., Port Melbourne (AU)

(72) Inventor: Zenja Solaja, Brighton East (AU)

(73) Assignee: Atlas Gaming Technologies Pty Ltd. (AU)

( * ) Notice: Subject to any disclaimer, the term of this patent is extended or adjusted under 35 U.S.C. 154(b) by 190 days.

(21) Appl. No.: 14/805,983

(22) Filed: Jul. 22, 2015

(65) Prior Publication Data

US 2016/0027243 A1 Jan. 28, 2016

(30) Foreign Application Priority Data

Jul. 23, 2014 (AU) ..... 2014902838

(51) Int. Cl.
*G07F 17/32* (2006.01)

(52) U.S. Cl.
CPC ..... *G07F 17/3225* (2013.01); *G07F 17/3223* (2013.01); *G07F 17/3269* (2013.01)

(58) Field of Classification Search
CPC ..... G07F 17/32
See application file for complete search history.

(56) References Cited

U.S. PATENT DOCUMENTS

2010/0227689 A1* 9/2010 Brunet de Courssou ..... G07F 17/32 463/37

* cited by examiner

*Primary Examiner* — Omkar Deodhar
(74) *Attorney, Agent, or Firm* — Lerner, David, Littenberg, Krumholz & Mentlik, LLP

(57) ABSTRACT

A method of presenting a game selection screen in a multi-game environment on a gaming machine is taught. The method being executed by a computerized game controller, the method comprising: (a) for each game $G_i$ in the multi-game environment, where i=1:the maximum number of games: ($a_i$) preparing frame buffers $FB_i$ by rendering the respective game's associated game screen into the respective $FB_i$; and ($a_{ii}$) recording a first time stamp; (b) recording a second time stamp, where the second time stamp is indicative of a time later than the first time stamp; and determining if one of the frame buffers $FB_i$ requires updating, and when a positive determination is made, preparing said frame buffer by rendering the respective game's associated game screen into the respective $FB_i$ using a delta time between the second time stamp and the first time stamp; and (c) forming dynamic icons for display on the game selection screen by rendering each previously prepared frame buffer $FB_i$ while controlling one or more visual aspects of the dynamic icons. Further provided is a game controller for a gaming machine having a display for presenting a game selection screen in a multi-game environment.

9 Claims, 4 Drawing Sheets

COMPUTERISED METHOD OF PRESENTING A GAME SELECTION SCREEN IN A MULTI GAME ENVIRONMENT

CROSS-REFERENCE TO RELATED APPLICATION

The present application claims priority from Australian provisional patent application number 2014902838 filed on 23 Jul. 2014, the content of which is hereby incorporated by reference herein.

TECHNICAL FIELD

Described embodiments relate generally to a gaming machine and to an improvement to a game played on such a gaming machine. More particularly, described embodiments relate to an improved method of presenting a game selection screen in a multigame environment.

BACKGROUND

Certain electronic gaming machines offer players a selection of different player selectable games. Such machines are often referred to as multi-game machines. On a multi-game machine, typically a game selection screen is presented to the player which would show a menu comprising a number of graphical icons representing the list of available games. From this screen a player is able to select which game they wish to play. Such icons are typically static images, or in some applications they may alternatively be a sequence of pre-rendered images to provide some form of animation. However, the icons present a limited amount of information to the player regarding the current state of the selectable game which can make it more difficult for the player to identify games that they like amongst the many games provided.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

In a first aspect, there is provided a method of presenting a game selection screen in a multi-game environment on a gaming machine. The method being executed by a computerized game controller, the method comprising:

(a) for each game $G_i$ in the multi-game environment, where i=1:the maximum number of games:

preparing frame buffers $FB_i$ by rendering the respective game's associated game screen into the respective $FB_i$; and recording a first time stamp;

(b) recording a second time stamp, where the second time stamp is indicative of a time later than the first time stamp; and determining if one of the frame buffers $FB_i$ requires updating, and when a positive determination is made, preparing said frame buffer by rendering the respective game's associated game screen into the respective $FB_i$ using a delta time between the second time stamp and the first time stamp; and (c) forming dynamic icons for display on the game selection screen by rendering each previously prepared frame buffer FBi whilst controlling one or more visual aspects of the dynamic icons.

Controlling the visual aspects of the dynamic icons may include one or more of positioning, rotation, scaling, fading and layout.

The method may further comprise displaying the dynamic icons during presentation of the game selection screen on a display of the gaming machine.

The method may further include determining if another one of the frame buffers FBi requires updating, and when a positive determination is made, preparing said another one of the frame buffers by rendering the respective game's associated game screen into the respective FBi using a delta time between the second time stamp and the first time stamp; and (c) forming dynamic icons for display on the game selection screen by rendering each previously prepared frame buffer FBi whilst controlling one or more visual aspects (such as scaling, position and rotation).

In a second aspect, there is provided a game controller for a gaming machine having a display for presenting a game selection screen in a multi-game environment, the game controller comprising:

one or more processors to control one or more operations to (a) for each game $G_i$ in the multi-game environment, where i=1:the maximum number of games:

prepare frame buffers $FB_i$ by rendering the respective game's associated game screen into the respective $FB_i$; and record a first time stamp;

(b) record a second time stamp, where the second time stamp is indicative of a time later than the first time stamp; and determine if one of the frame buffers $FB_i$ requires updating, and when a positive determination is made, to prepare said frame buffer by rendering the respective game's associated game screen into the respective $FB_i$ using a delta time between the second time stamp and the first time stamp; and (c) form dynamic icons for display on the game selection screen by rendering each previously prepared frame buffer $FB_i$ whilst controlling one or more visual aspects (such as scaling, position and rotation).

In a third aspect, there is provided a gaming machine having a display for presenting a game selection screen in a multi-game environment on a gaming machine. The gaming machine comprising:

a display;

a memory to store data in frame buffers;

a processor to:

(a) for each game $G_i$ in the multi-game environment, where i=1:the maximum number of games:

prepare frame buffers $FB_i$ by rendering the respective game's associated game screen into the respective $FB_i$; and record to memory a first time stamp;

(b) record to memory a second time stamp, where the second time stamp is indicative of a time later than the first time stamp; and determine if one of the frame buffers $FB_i$ requires updating, and when a positive determination is made, preparing said frame buffer by rendering the respective game's associated game screen into the respective $FB_i$ using a delta time between the second time stamp and the first time stamp; and (c) form dynamic icons for display on a game selection screen on the display of the gaming machine by rendering each previously prepared frame buffer $FB_i$ whilst controlling one or more visual aspects of the dynamic icons.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

In order that the present invention may be more clearly ascertained, embodiments will now be described, by way of example, with reference to the accompanying drawing, in which.

DESCRIPTION OF THE EMBODIMENTS

Figure 1:
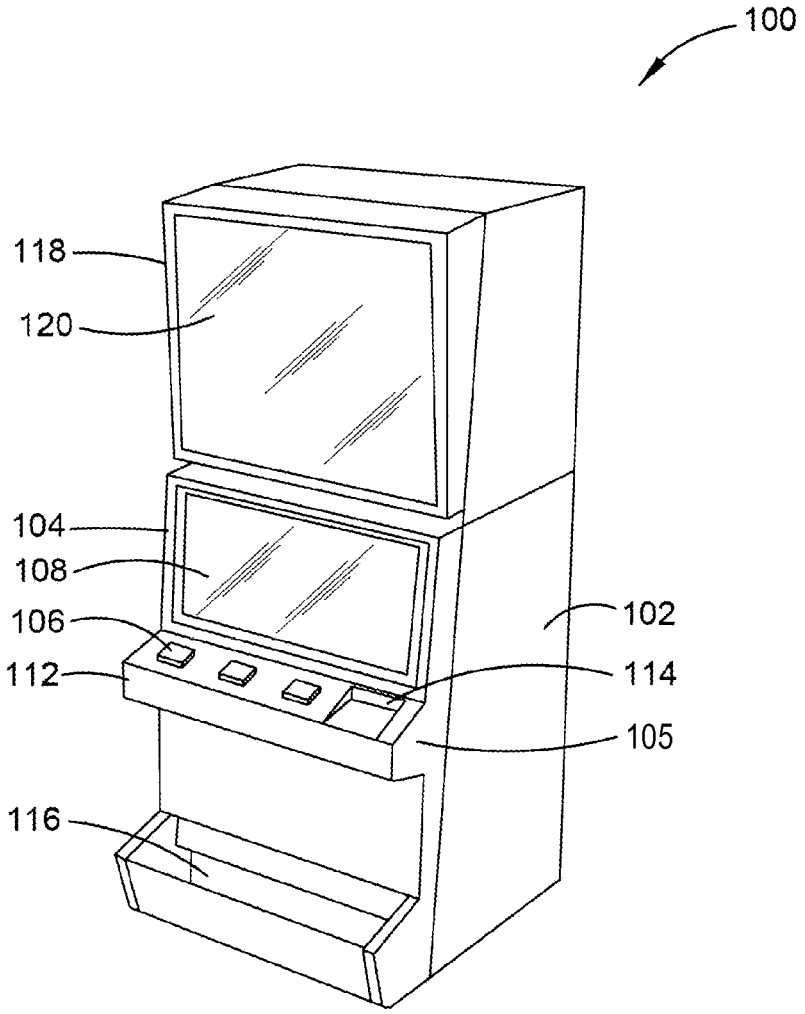
FIG. 1 shows a perspective view of a gaming machine.

Described embodiments generally relate to a gaming machine having interactive virtual objects, and a method of gaming on a gaming machine having interactive virtual objects. The gaming system can take a number of different forms. In a first form, a stand-alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

In another form, the gaming system may comprise a gaming server (or multiple gaming servers) interacting with client computing devices over a wired and/or wireless network to allow performance of the games on the client devices. Such client devices may include desktop computers, tablet computers, laptop computer and handheld computing devices (including smart phones), for example, each of which includes at least one processor and memory to store executable instructions for performing the game-related functions described herein. Such systems may therefore not require specific dedicated physical gaming machines as described herein in relation to FIGS. 1 and 2, since the client devices can in such systems perform some of the gaming functions as described herein. In such gaming systems, the client devices may locally execute gaming applications that communicate with the gaming server and, in combination with the gaming server, provide a user interface and gaming experience generally similar to that of a physical gaming machine. Thus, embodiments described herein in relation to gaming machines may be implemented "on-line" using such a client-server architecture, unless such implementations would not be physically or technologically feasible. Additionally, some embodiments described herein in relation to gaming machines may be implemented in a personal computing device without requiring interaction with a server, in which case such computing devices can be termed "gaming machines".

One or more of the method steps described in this disclosure may be implemented by executable instructions and parameters 232, 234 (See FIG. 2), stored in the memory 204, 206, 230 (See FIG. 2), that may form software embodiments of the system 100. These instructions 232, 234 that form the system 100 may be executed by the CPU 202 (See FIG. 2) or any other processor. Further, the processor 202, the memory 204, 206, 230, the instructions 232, 234 stored therein, or a combination thereof may serve as a means for performing one or more of the method steps described herein.

Figure 2:
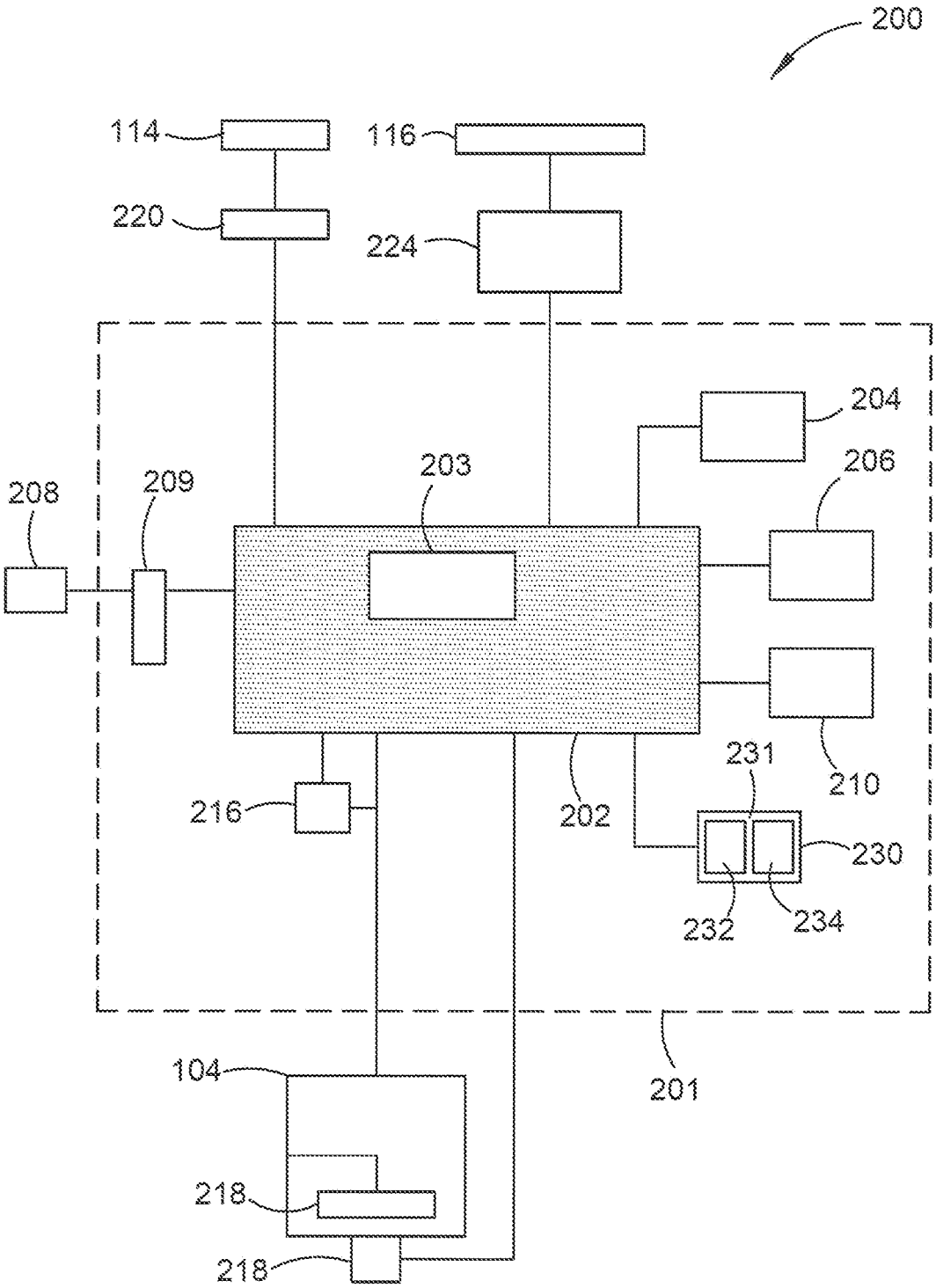
FIG. 2 shows a block diagram of a game logic circuit of the gaming machine illustrated in FIG. 1.

Irrespective of the form, the gaming system 100 has several core components. At the broadest level, the core components are a player interface in the form of a touch screen 108 as illustrated in FIG. 1 and a game controller 201 as illustrated in FIG. 2. The player interface is arranged to enable manual interaction between a player and the gaming system and for this purpose includes the input/output components required for the player to enter instructions and play the game.

Referring now to FIG. 1, reference numeral 100 generally designates a stand-alone gaming system including a game. Hereinafter, the stand-alone gaming system 100 will be referred to as a gaming machine.

The gaming machine 100 includes a console 102 which contains all or most components required to implement a game play whereby a player wins or loses a wager. Access to the components is by way of a hinged door 105. Moulded to the exterior of the console 102 is a display means in the form of at least one visual display unit 104 on which one or more games is played. The video display unit 104 may be implemented as a liquid crystal display, a plasma screen, as a cathode ray screen device or the like. Whilst the console 102 illustrated in FIG. 1 shows a single visual display unit 104, there can be more than one visual display unit on a typical machine. What is displayed on the visual display unit 104 will depend on what the intended goal of the unit is in relation to the player and any other potential participants in the gaming system.

The gaming machine includes a tactile input for a player to interact via touch with the gaming machine 100. In this example, the tactile input is in the form of a combination of pushbuttons 106 and a touch screen 108 for enabling a player to play one or more games. The touch screen is an electronic visual display that can detect the presence and location of a touch within the display area. The touch screen 108 is used during the game play between start of a game and the end of a game. A game is considered to have started once a wager is placed and considered complete once the wager has been lost or won. Certain functions of the pushbutton are: initiation of game play, credit output, gameplay selection, completion of gameplay etc. A midtrim 112 of the machine 100 houses the pushbuttons 106.

The tactile input may optionally or further include a joystick comprising of a stick that pivots on a base and reports its angle or direction to the device it is controlling. The tactile input may optionally or further include a trackpad/touchpad being a pointing device featuring a tactile sensor to translate the motion and position of a user's fingers to a relative position on screen.

It should be appreciated that tactile input may include any suitable device that enables the player to produce an input signal that is received by the processor. Tactile input in the form of pushbuttons 106 and/or regions on touch screen 108 may include a one bet button, a max bet button, or a repeat the bet button. With a one bet button for instance, the player places a bet by pushing the one bet button. The player may increase the bet by one credit each time the player pushes the bet one button.

The midtrim 112 also houses credit input device including a bill collector 114. The credit input device may further include a coin input chute, a card and/or ticket reader, a magnetic reading head for reading a magnetic stripe card, an electronic reader for a proximity card, a near field communications reader or any other form of electronic, wireless or contact that can input credit to the gaming machine.

A credit dispenser in the form of a coin tray 116 is mounted beneath the console 102 and is provided for cash payouts from the machine 100 to the player. A hopper device (not shown) is provided which dispenses coins, or tokens equal to the amount of credit currently on the machine, into the coin tray 116. Aside from the coin tray 116, the credit dispenser may also include a ticket dispenser for issuing a ticket dispensed by a printer which the user can redeem for cash, a note dispenser, a near field communications transmitter or means to enable remote credit transfer. It should be appreciated that any suitable payout mechanisms, such as funding to the player's electronically recordable identification card or smart card, may be implemented in accordance with the gaming machine disclosed herein.

The gaming machine 100 includes a top box 118 on which artwork 120 is carried in the form of electronic visual display units. The artwork 120 could also be made from physical materials such as paper, plastic banners or posters. The artwork 120 may have generic information related to the machine or gaming system or the artwork 120 be specifically made for a particular game to be played on the machine 100. Whilst the artwork 120 is shown as being carried on the top box 118 the art work 120 can also be positioned in or on the bottom panel of the door 105, or any other part of the gaming machine 100 visible to the player.

The gaming machine 100 further includes an auditory unit in the form of speakers (not shown) to provide auditory feedback to the player of the gaming machine 100.

Referring to FIG. 2 of the drawings, game logic circuitry 200 is illustrated. The game logic circuitry 200 includes a gaming controller 201 (otherwise referred to as a logic cage) designated by the dashed lines. As will be appreciated by those skilled in the gaming industry, the logic cage 201 includes a box-like mechanical structure that has slots to guide logic cards into the proper location for electronically plugging into a backplane mounted at the rear of the cage structure. The backplane has connectors for accepting mating connectors on the logic cards. The logic cage and associated cards form one of the basic components of the gaming machine 100 and is securely housed within the cabinet of the gaming machine 100.

Central to the logic cage is a central processing unit 202 such as a processor, a microcontroller-based platform, a suitable integrated circuit, or one or more application-specific integrated circuits (ASIC's). The processor 202 is in communication with or operable to access or to exchange signals with at an outcome evaluator 203, RAM 204, ROM 206, a non-volatile memory in the form of a compact flash 230, an audio output 208 via an audio control module 209, and a random number generator 210. The audio control module 209 has its own digital signal processor, analogue to digital converters, amplifiers and other circuitry necessary to broadcast the output from the speakers. RAM 204 may include non-volatile RAM (NVRAM), magnetic RAM (MRAM), ferroelectric RAM (FeRAM), and other forms as commonly understood in the gaming industry.

Compact flash memory 230 is physically secured within a slot in the logic cage 201. In one embodiment, the compact flash memory 230 is physically secured inside the logic cage within game logic circuitry 200 by a mechanical locking mechanism. Compact flash memory 230 is partitioned 231 into two parts. A first part comprises a game software module 232 and a second part comprises a metering information module 234.

The processor 202 runs executable code residing in game software module 232 of compact flash 230 that facilitates play of the game by a player through the display device and/or push buttons and touch sensors mounted in the screen of the display. Metering information module 234 contains the gaming machine parameters which include values that would usually be stored on a hard meter. The values in metering information module 234 are only ever incremented, and cannot be reset or decremented. The only way to alter the values stored is by running the executable code stored in game software module 232, which is executed by processor 202. The executable code further interacts with the credit dispenser 116 via a payout mechanism 224 and the auditory output 208. The game software module 232 contains the rules of the game, the sequence of gameplay, communicates with external systems, monitors peripheral equipment, maintain integrity of the software code, etc. The processor 202 continually checks for error conditions.

A program which implements the game logic circuitry 200 and the user interface is further run by the central processing unit 202. The processor 202 forms part of a controller 216 that drives the screen of the video display unit 104 and that receives input signals from sensors 218. The sensors 218 include sensors associated with the push buttons and touch sensors mounted in the screen of the video display unit 104. The controller 214 also receives input pulses from mechanisms 220 and 224 to determine whether or not a player has provided sufficient credit from either payment device 114 or payment device 116 to commence playing.

In one embodiment, a player may insert an identification card into a card reader (not shown) of the gaming machine 100. Such an identification card may be a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a mobile phone, a radio frequency identification tag, or any other suitable wireless device, that communicates a player's identification, credit totals (or related data), and other relevant information to the gaming device.

Figure 3:
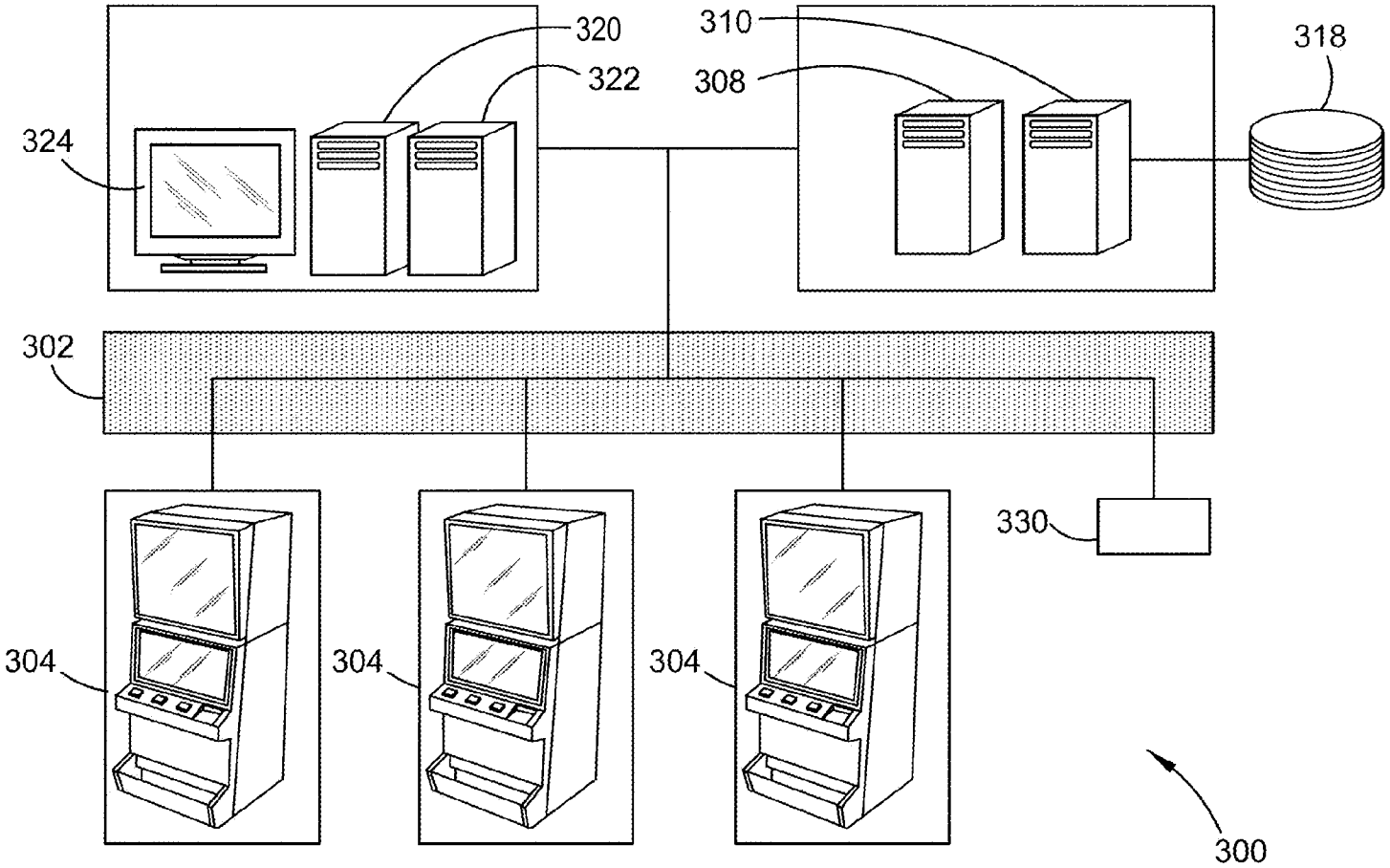
FIG. 3 shows a block diagram of functional components of a gaming system incorporating gaming machines illustrated in FIG. 1.

FIG. 3 shows a gaming system 300 in accordance with an alternative embodiment. The gaming system 300 includes a network 302, which for example may be an Ethernet network. The network 302 may also comprise a wide area network ("WAN"), the plain-old-telephone-system ("POTS), a local area network ("LAN"), a wireless LAN, the Internet, or any combination of these and other types of networks. Gaming machines 304 are connected to the network 302. The gaming machines 304 provide a player operable interface and may be the same as the gaming machines 100 shown in FIG. 1 or may have simplified functionality depending on the requirements for implementing game play.

In a thick client embodiment, game server 308 implements part of the game played by a player using a gaming machine 304 and the gaming machine 304 implements part of the game. With this embodiment, as both the game server 308 and the gaming device implement part of the game, they collectively provide a game controller. A database management server 310 may manage storage of game programs and associated data for downloading or access by the gaming devices 304 in a database 318.

In a thin client embodiment, game server 308 implements most or all of the game played by a player using a gaming machine 304 and the gaming machine 304 essentially provides only the player interface. With this embodiment, the game server 308 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 300, including for example a gaming floor management server 320, and a licensing server 322 to monitor the use of licenses relating to particular games. An administrator terminal 324 is provided to allow an administrator to run the network 302 and the devices connected to the network.

The gaming system 300 may communicate with other gaming systems, other local networks, for example a corporate network, and/or a wide area network such as the Internet, for example through a firewall 330.

Persons skilled in the art will appreciate that in accordance with known techniques, functionality at the server side of the network may be distributed over a plurality of different computers. For example, elements may be run as a single "engine" on one server or a separate server may be provided. For example, the game server 308 could run a random generator engine. Alternatively, a separate random number generator server could be provided. Further, persons skilled in the art will appreciate that a plurality of game servers could be provided to run different games or a single game server may run a plurality of different games as required by the terminals.

Figure 4A:
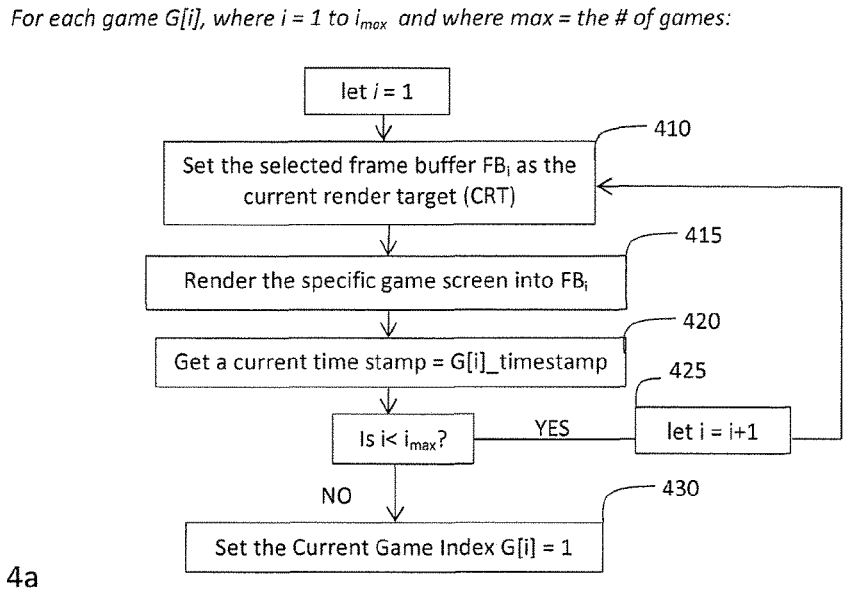
FIG. 4*a* shows a flow chart illustrating a pre-render step in accordance with an embodiment of the invention.

An example method of gaming will now be described with reference to FIGS. 4*a*, 4*b* and 5. In a thick client embodiment, the methodology illustrated in FIGS. 4*a* and 4*b* may be implemented by a processor (e.g. 202 in FIG. 2) of a gaming machine 100. In a thin client embodiment, the methodology illustrated in FIGS. 4*a* and 4*b* may be implemented by the game server (e.g. 308 in FIG. 3) in conjunction with gaming machine (e.g. 304 in FIG. 3).

As will be appreciated from the foregoing, using game code and graphic libraries stored on the gaming machine, the processor 202 generates a game presentation which is presented on the video display unit 104. The game presentation in this non-limiting example is a rapid sequence of frames updated at a rate of 60 frames/second. Each frame in a sequence of frames in a game presentation is stored temporarily in the video controller 216, although the gaming machine 100 could include a video card with a separate memory and processor for performing graphic functions on the gaming machine. The video controller 216 includes at least as many frame buffers (not shown) as there are games able to be played on the gaming machine 100. The frame buffer may consist of RAM, VRAM, SRAM, SDRAM, and the memory size of each frame buffer is related to the resolution used on the video 104 and the number of colors used to render the presentation. Generally, each frame buffer stores frame data and provides image data which specifies the pixels to be displayed on the display screen.

Initialization Step

On initialization of the gaming machine 100, new frame buffers are created whose dimensions match the physical screen size. For instance if the screen size of the physical display unit 104 is 1920×1080 with 24 bits per pixel and if four games are available to a player, then four separate frame buffers of size 1920×1080 with 24 bits per pixel are created. As should be apparent, as many frame buffers as number of available games will be created. In the foregoing example, there are four possible games able to be played on the gaming machine 100.

Pre-Render Step

Each time a player accesses the game selection screen, via a menu entry (not shown), the processor 202 according to the game code stored in game software module 232, operates in accordance with the methodology described with reference to FIG. 4*a*.

For each game G[i], where i is equal to 1 to $i_{max}$, and where max is equal to the maximum number of games (in this case four), the selected frame buffer $FB_i$ (which corresponds to each game G[i]), is set as the current render target CRT, step 410. The specific game screen is then rendered into the selected frame buffer $FB_i$, step 415. This creates the initial icon image for this game and consists of a screenshot of that game. A current time stamp G[i]_timestamp is recorded, step 420. This process repeats, step 425 until a screenshot has been obtained for each game and rendered into the appropriate frame buffer $FB_i$. The current game index is then set to 1, step 430. At this point an initial icon image has been created for each of the available games. Steps 410 to 425 are in effect a pre-render step and the icon images at this point are not displayed to the player.

Rendering Step

Figure 4B:
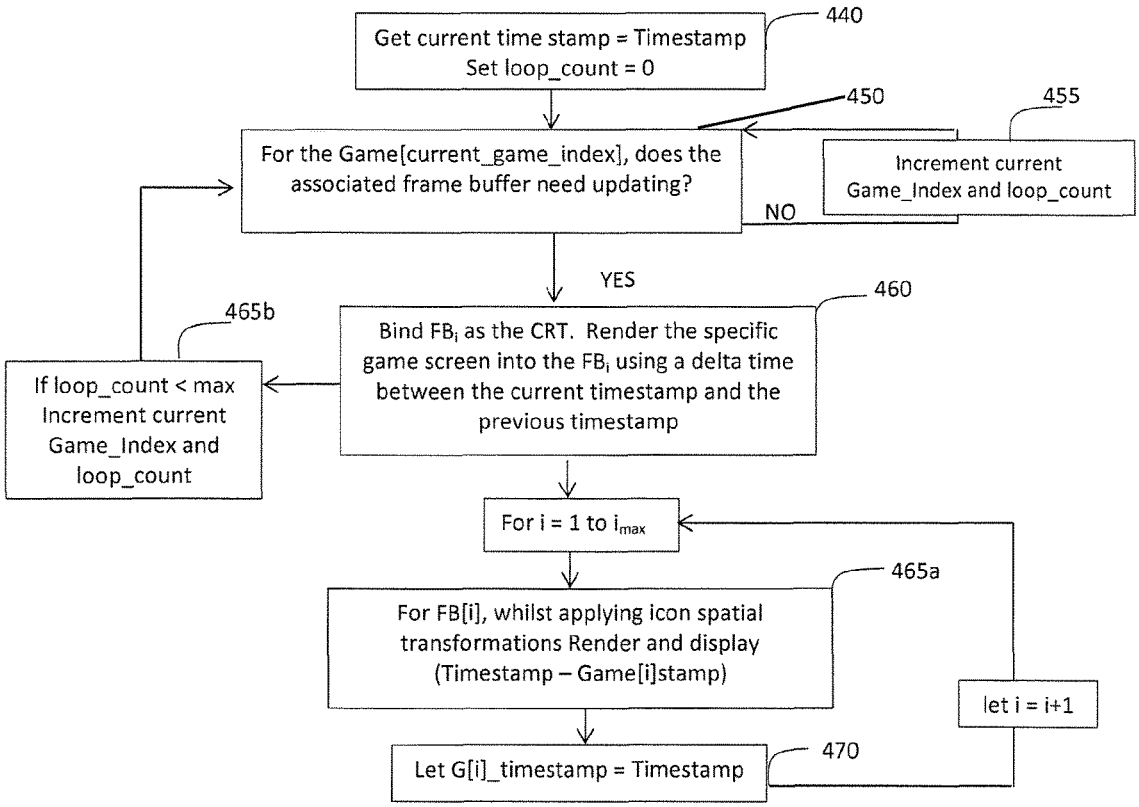
FIG. 4*b* shows a flow chart illustrating the rendering step in accordance with an embodiment of the invention.

Whilst the game selection screen is visible, the methodology then progress to that illustrated in FIG. 4*b*. A current timestamp: Timestamp, is recorded and the loop count set to zero, step 440. The processor 202 operates to determine for the Game[current game index], if the associated frame buffer FB needs updating, step 450. Typically updating is not required for games which have no active animations, such games are typical of non-winning games. Games with active animations will require updating.

If a frame buffer update is not necessary, and if the list of games to render is not exhausted, the current_game_index and loop counter are incremented, step 455, and the methodology returns to step 450 for the next game in the sequence. If an update is necessary, then the specific game screen is rendered into the selected frame buffer $FB_i$ using a delta time between the current timestamp and the previous timestamp, step 460.

At this stage, at most, one of the frame buffers has been updated. Each of the frame buffers are now displayed on the video display unit 104. For each game, each of the previously prepared frame buffers $FB_1$, $FB_2$, $FB_3$, and $FB_4$ are rendered whilst having applied, icon spatial transformations which sets the scale, position and rotation of the dynamic icons, step 465*a*. Since there are four games available to a player on this gaming machine, the dynamic icons representing each respective game have the same scale and they are positioned in a 2×2 matrix on the video display unit 104. Timestamps associated with each game are also updated, step 470. This completes a single frame's render cycle.

Concurrently, in step 465*b*, the current_game_index and loop counter are incremented, and the methodology returns to step 450 for the next game in the sequence, and hence a new frame render cycle.

As should be apparent, with the next iteration of the loop, the next frame buffer in the cycle is refreshed. By way of example, if only a single game in a set of games, for instance $G_2$ requires updating, then the methodology update $G_2$'s frame buffer every frame. However, if all four games require refreshing, the methodology will update each game's frame buffer every $4^{th}$ frame. This later example effectively renders each game at ¼ the frame-rate, however with the incorporation of the delta time ensures that motion is still in time-step.

During a frame's render cycle, the methodology effectively updates only a single game's frame buffer, while other games use their previously prepared frame buffer. This method allows the efficient presentation of multiple game images (screenshots) without incurring the performance penalty of updating every games frame buffers per frame.

The methodology of the invention efficiently renders the screenshots of respective games to achieve acceptable performance on hardware which is not capable of rendering each game's screenshot in real-time.

In an alternative, though less preferred embodiment, all games always render to a respective frame buffer, even when a dynamic icon indicative of the game is not in the game selection screen. In this embodiment, and when a dynamic icon indicative of a game is not displayed in the game selection screen, all previously prepared single frame buffers are presented full screen. There is no need to recreate the initial screenshots, since the screenshots are already in the frame buffers.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive. Whilst the game presentation has been described as a rapid sequence of frames updated at a rate of 60 frames/second, it should be appreciated that the rate is dependent upon the current technology. Panels are currently available that update a rate of 120 or 200 frames/second and some display panels operate to update at a variable rate.

While the foregoing description has been provided by way of example of the preferred embodiments of the present invention as presently contemplated, which utilize gaming machines of the type found in casinos, those skilled in the relevant arts will appreciate that embodiments of the present invention also may have application to internet gaming and/or have application to gaming over a telecommunications network, where mobile handsets are used to display game outcomes and receive player inputs. Such mobile devices include smart phones, notebooks, tablets, iPads and laptop computers. For instance free mobile device games may be offered for download and play on a players personal mobile device as a bonus game play. In such an embodiment the gaming machine may comprise a power interface to enable interaction between the respective devices and/or a communication or wireless interface to enable data transfer. During game play, the gaming machine may be configured to send information to the player's personal mobile device.

Further embodiments may enable a player to upload the outcome of a game or bonus game to a social media site(s), post tournament scores etc.

Certain steps in the processes or process flows described in this disclosure naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

Additionally, one of ordinary skill in programming is able to write computer code or identify appropriate hardware and/or circuits to implement the disclosed invention without difficulty based on the flow charts and associated description in this specification, for example.

Therefore, disclosure of a particular set of program code instructions or detailed hardware devices is not considered necessary for an adequate understanding of how to make and use the invention. The inventive functionality of the claimed computer implemented processes is explained in more detail in the above description and in conjunction with the figures which may illustrate various process flows.

In one or more exemplary aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another.

A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks usually reproduce data magnetically, while discs reproduce data optically with lasers. Combinations of the above should also be included within the scope of computer-readable media.

Although selected aspects have been illustrated and described in detail, it will be understood that various substitutions and alterations may be made therein without departing from the spirit and scope of the present invention.

The invention claimed is:

1. A method of presenting a game selection screen in a multi-game environment on a gaming machine, the method executed by a computerized game controller and comprising:

(a) for each game Gi in the multi-game environment, where i=1:the maximum number of games:

preparing frame buffers FBi by rendering the respective game's associated game screen into the respective FBi; and recording a first time stamp;

(b) recording a second time stamp, where the second time stamp is indicative of a time later than the first time stamp; and determining if one of the frame buffers FBi requires updating, and when a positive determination is made, preparing said frame buffer by rendering the respective game's associated game screen into the respective FBi using a delta time between the second time stamp and the first time stamp; and (c) forming dynamic icons for display on the game selection screen by rendering each previously prepared frame buffer FBi whilst controlling one or more visual aspects of the dynamic icons.

2. A method according to claim 1, wherein controlling the one or more visual aspects of the dynamic icons includes one or more of controlling the positioning, rotation, scaling, fading and layout of the dynamic icons.

3. The method according to claim 1, further comprising displaying the dynamic icons during presentation of the game selection screen on a display of the gaming machine.

4. The method according to claim 1, further comprising:

(d) determining if another one of the frame buffers $FB_i$ requires updating, and when a positive determination is made, preparing said another one of the frame buffers by rendering the respective game's associated game screen into the respective $FB_i$ using a delta time between the second time stamp and the first time stamp; and (e) forming dynamic icons for display on the game selection screen by rendering each previously prepared frame buffer $FB_i$ whilst controlling one or more visual aspects of the dynamic icons.

5. A game controller for a gaming machine having a display for presenting a game selection screen in a multi-game environment, the game controller comprising:

one or more processors to control one or more operations to (a) for each game $G_i$ in the multi-game environment, where i=1:the maximum number of games:

prepare frame buffers $FB_i$ by rendering the respective game's associated game screen into the respective $FB_i$; and record a first time stamp;

(b) record a second time stamp, where the second time stamp is indicative of a time later than the first time stamp; and determine if one of the frame buffer $FB_i$ requires updating, and when a positive determination is made, to prepare said frame buffer by rendering the respective game's associated game screen into the respective $FB_i$ using a delta time between the second time stamp and the first time stamp; and (c) form dynamic icons for display on the game selection screen by rendering each previously prepared frame buffer $FB_i$ whilst controlling one or more visual aspects of the dynamic icons.

6. A game controller according to claim 5, wherein controlling the one or more visual aspects of the dynamic icons includes one or more of controlling the positioning, rotation, scaling, fading and layout of the dynamic icon.

7. A game controller according claim 5, configured to display the dynamic icons during presentation of the game selection screen on a display of the gaming machine.

8. A game controller according to claim 5, configured to:

(d) determine if another one of the frame buffers $FB_i$ requires updating, and when a positive determination is made, preparing said another one of the frame buffers by rendering the respective game's associated game screen into the respective $FB_i$ using a delta time between the second time stamp and the first time stamp; and (e) form dynamic icons for display on the game selection screen by rendering each previously prepared frame buffer $FB_i$ whilst controlling one or more visual aspects of the dynamic icons.

9. A game controller according to claim 8, where the one or more visual aspects include scaling, position and rotation.

* * * * *